US006250424B1

(12) United States Patent
Laug

(10) Patent No.: US 6,250,424 B1
(45) Date of Patent: Jun. 26, 2001

(54) LADDER SUPPORT

(76) Inventor: Horst Laug, Hauselünner Strasse 72, D-49809 Lingen (DE)

( * ) Notice: Subject to any disclaimer, the term of this patent is extended or adjusted under 35 U.S.C. 154(b) by 0 days.

(21) Appl. No.: 09/398,693

(22) Filed: Sep. 20, 1999

Related U.S. Application Data

(63) Continuation of application No. PCT/DE98/00792, filed on Mar. 18, 1998.

(30) Foreign Application Priority Data

Mar. 20, 1997 (DE) ..... 197 11 643
Apr. 25, 1997 (DE) ..... 197 17 424

(51) Int. Cl.[7] ..... E06C 7/48
(52) U.S. Cl. ..... 182/107; 182/214
(58) Field of Search ..... 182/107, 214

(56) References Cited

U.S. PATENT DOCUMENTS 2,327,317 * 8/1943 Randall ..... 182/107
3,072,218 * 1/1963 Peters ..... 182/214
3,459,277 * 8/1969 Frederick ..... 182/214
3,773,143 * 11/1973 Del Bete ..... 182/214
4,232,759 * 11/1980 Jacobs ..... 182/214
4,359,138 * 11/1982 Kummerlin ..... 182/107
4,394,887 * 7/1983 Spinks ..... 182/107
4,615,412 * 10/1986 Clarke ..... 182/107
5,899,296 * 5/1999 Cantz ..... 182/214

FOREIGN PATENT DOCUMENTS

217052 * 11/1956 (AU) ..... 182/214
355504 * 2/1990 (EP) ..... 182/107
409949 * 5/1934 (GB) ..... 182/214
2260358 * 4/1993 (GB) ..... 182/214
94029561 * 12/1994 (WO) ..... 182/214

* cited by examiner

*Primary Examiner*—Alvin Chin-Shue
(74) *Attorney, Agent, or Firm*—Herbert L. Lerner; Laurence A. Greenberg; Werner H. Stemer

(57) ABSTRACT

A ladder support, in particular for corners of buildings, includes an angle bracket fitted directly or indirectly to the top end of a ladder by support arms of variable length. The angle bracket has spacers. Rollers are placed individually or in pairs at the free ends of the spacers. The rollers are variable in length and articulation. The support arms are each connected to the side rail of the ladder by a detachable clamping device. The angle bracket can be attached to a bearing bar, with the bearing bar attached to the support arms.

20 Claims, 3 Drawing Sheets

LADDER SUPPORT

Cross-Reference to Related Application

This is a continuation of copending International Application No. PCT/DE98/00792, filed Mar. 18, 1998, which designated the United States.

BACKGROUND OF THE INVENTION

1. Field of the Invention

The invention lies in the field of ladders. The invention relates to a ladder support, in particular for building corners.

For manual work carried out on building corners or in the vicinity of building corners, or on or near rainwater downspouts, leaning ladders are generally positioned laterally alongside the corners, with the result that the person standing on the ladder is forced to lean out beyond the ladder in order to carry out the work. Therefore, the effective working area is vastly restricted because it is only possible to lean out to a certain extent beyond the tilting axis while still maintaining an adequate degree of safety.

International PCT publication WO94/29561 discloses a ladder support. The disadvantage with the prior art abutment angle, however, is low adjustability level and flexibility in different use situations.

2.Summary of the Invention

It is accordingly an object of the invention to provide a ladder support that overcomes the hereinafore-mentioned disadvantages of the heretofore-known devices of this general type and that is of straightforward construction, is easy to install and insures safer working over larger areas in the region of the building corners while maintaining stability, even when the ladder is subjected to eccentric loading.

With the foregoing and other objects in view, there is provided, in accordance with the invention, a ladder support, in particular for corners of buildings, including a bearing bar, an abutment angle connected to the bearing bar, the abutment angle having an inside and an outside, at least two spacers disposed on the inside of the abutment angle, at least two displaceably guided supporting rods disposed on the outside of the abutment angle for releasably attaching the abutment angle to a ladder.

In accordance with another feature of the invention, the abutment angle has two legs, the two legs are adjustable in length, the at least two spacers are adjustable in length and the at least two supporting rods are adjustable in length.

In accordance with a further feature of the invention, each of the at least two spacers has a running roller.

In accordance with an added feature of the invention, the running roller is a pair of running rollers.

In accordance with an additional feature of the invention, the running roller is disposed on each of the at least two spacers in an articulated manner.

In accordance with yet another feature of the invention, the running roller is adjustable in length.

In accordance with yet a further feature of the invention, each of the at least two spacers is laterally adjustable on the inside of the abutment angle.

In accordance with yet an added feature of the invention, each of the at least two supporting rods are fastened to a ladder by a releasable clamping device.

In accordance with yet an additional feature of the invention, the clamping device is angularly adjustable.

In accordance with again another feature of the invention, the abutment angle is securably fastened to the bearing bar.

In accordance with again a further feature of the invention, the abutment angle is rotatably mounted to the bearing bar.

In accordance with again an added feature of the invention, there is provided at least two rollers, the bearing bar having two ends, each of the two ends having at least one of the at least two rollers.

In accordance with again an additional feature of the invention, each of the two ends has a roller pair.

In accordance with still another feature of the invention, the at least one of the at least two rollers is adjustably guided on each of the two ends of the bearing bar.

In accordance with still a further feature of the invention, each of the two ends of the bearing bar has sides defining a cavity and the at least one of the at least two rollers is adjustably guided within the cavity.

In accordance with still an added feature of the invention, the abutment angle has two legs, each of the two legs having respective ends, and each of the ends has a telescopic extension arm.

In accordance with still an additional feature of the invention, the telescopic extension arm is angled.

In accordance with another feature of the invention, the telescopic extension arm has at least one roller.

In accordance with a further feature of the invention, there is provided at least two displaceable spacers, the abutment angle having two legs, and at least one of the at least two displaceable spacers are displaceably guideable along each of the two legs of the abutment angle.

In accordance with a concomitant feature of the invention, the at least two displaceable spacers are adjustable in length.

Other features that are considered as characteristic for the invention are set forth in the appended claims.

Although the invention is illustrated and described herein as embodied in a ladder support, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
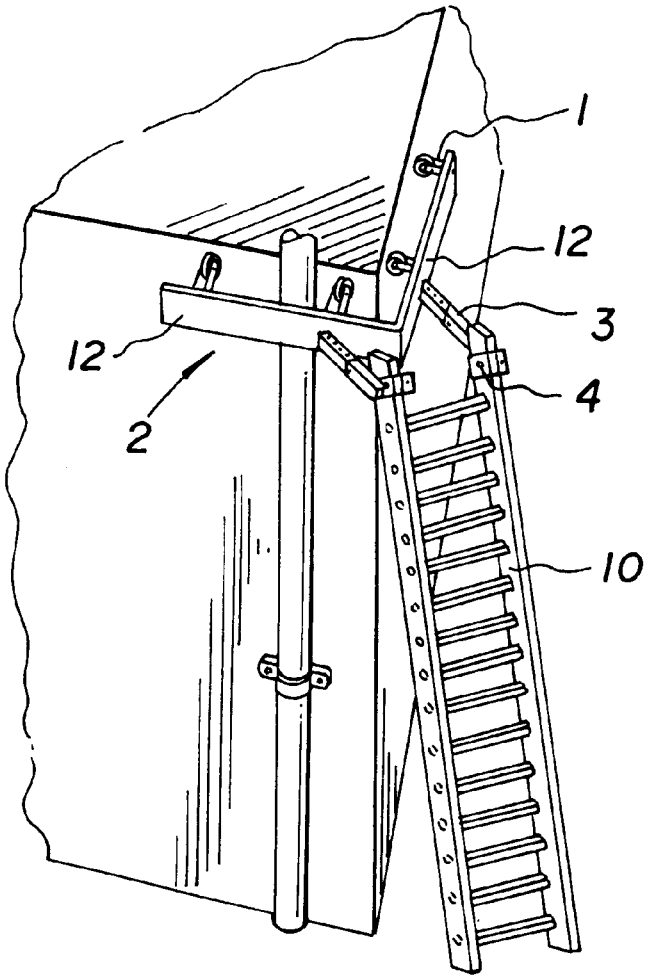
FIG. 1 is a perspective view of a building-corner support for a ladder according to the invention.

In all the figures of the drawing, sub-features and integral parts that correspond to one another bear the same reference symbol in each case now to the figures of the drawings in detail and first, particularly to FIG. 1 thereof, there is seen a ladder 10 connected to an abutment angle 2 by two supporting arms 3 that are adjustable in length. The supporting arms 3 are connected to the side rails of the ladder 10 by a respective releasable clamping device 4. The clamping device can be angularly adjustable. The abutment angle 2 has two legs 12. Disposed on the inside of each abutment angle leg 12 are two spacers 1 with running rollers. The spacers 1 are adjustable in length.

Figure 2:
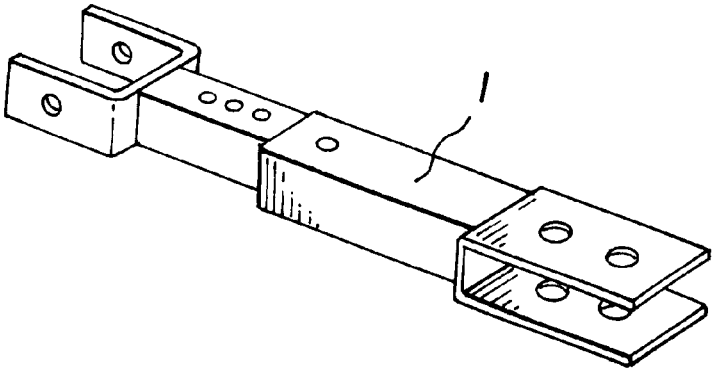
FIG. 2 is a perspective view of a ladder spacer according to the invention.

FIG. 2 shows an embodiment of an adjustable spacer 1 without a running roller.

Figure 3:
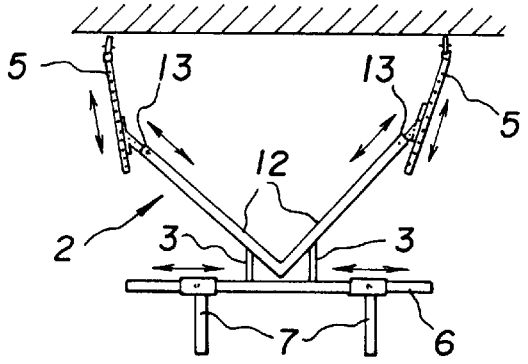
FIG. 3 is a plan view of a ladder support with extension arms according to the invention.

According to FIG. 3, the abutment angle 2 is connected, through its supporting arms 3, to a bearing bar 6 that, in turn, is connected to the ladder 10 by displaceably guided supporting rods 7 Telescopic extension arms 5 having rollers are disposed at the free ends 13 of the abutment angle 2.

Figure 4:
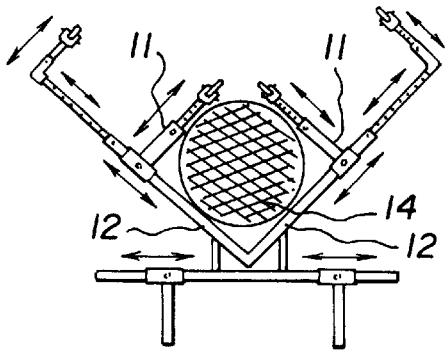
FIG. 4 is a plan view of a ladder support variant for use on a pole according to the invention.

As shown in FIG. 4, when the ladder is used on a pole 14, displaceable spacers 11 that are adjustable in length are guided onto the legs 12 of the abutment angle 2. The legs 12 adjust along their length by extension rods 16.

Figure 5:
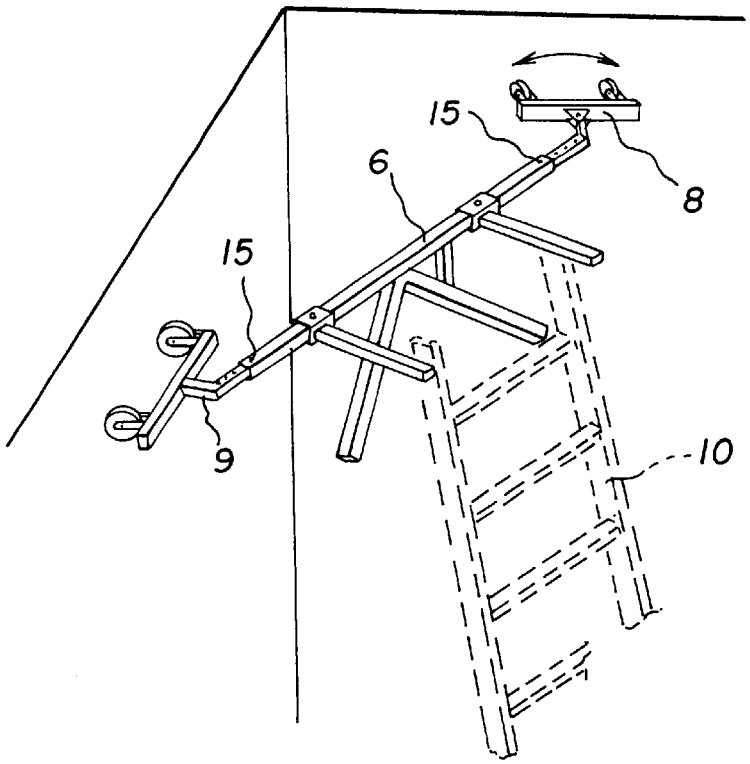
FIG. 5 is a perspective partial view of a ladder support for use on an inner corner according to the invention.
Figure 6:
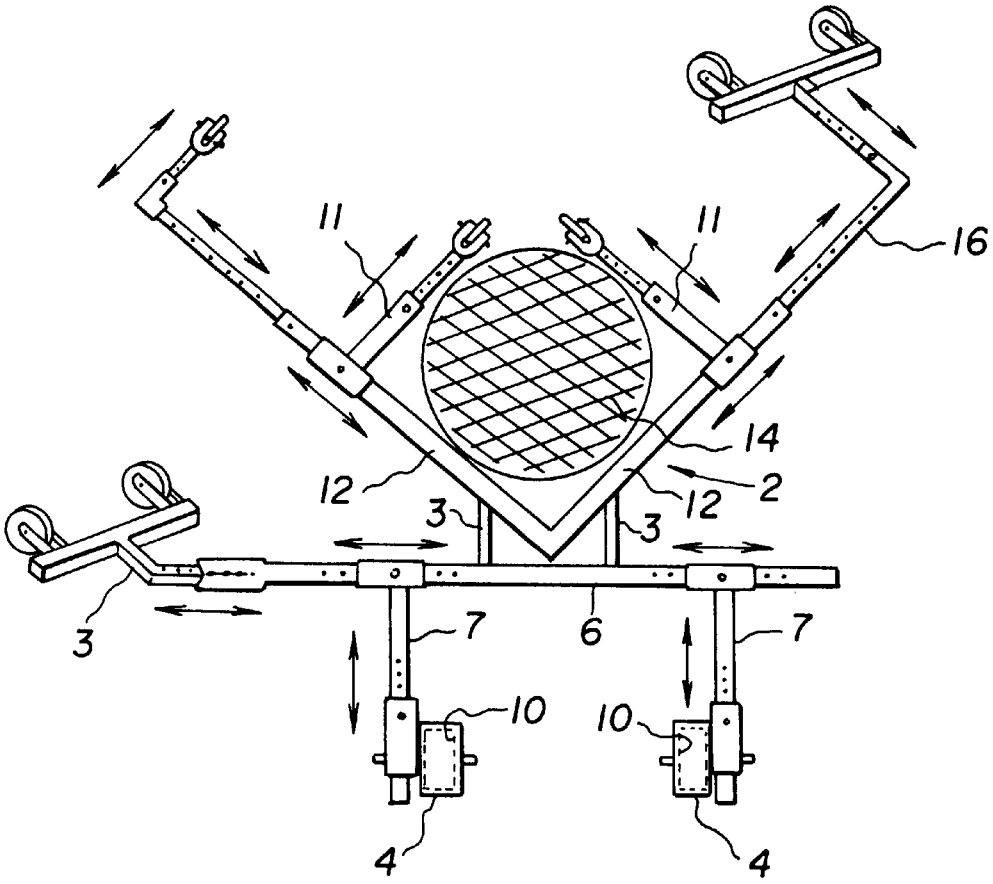
FIG. 6 is a plan and partial perspective view of a ladder support variant for use on a pole according to the invention.

In accordance with FIG. 5, the bearing bar 6 is shown as rotatably mounted, allowing for use on a inner corner of a wall. Disposed on the ends 15 of the bearing bar 6 are roller pairs 8, 9 that are guided in a cavity of the bearing bar 6 to permit adjustability in length. In FIG. 5, the roller pair 8 is installed in an articulated manner and the roller pair 9 is installed in a fixed manner.

I claim:

1. A lean-to ladder support for corners of structures, comprising:

a bearing bar having ends;

an abutment angle connected to said bearing bar, said abutment angle having an inside and an outside;

at least two spacers disposed on said inside of said abutment angle;

at least two displaceably guided supporting rods rotatably disposed at said bearing bar for releasably attaching said bearing bar and said abutment angle to a ladder; and rollers connected to each of said ends.

2. The ladder support according to claim 1, wherein said abutment angle has two legs, said two legs are adjustable in length, said at least two spacers are adjustable in length and said at least two supporting rods are adjustable in length.

3. The ladder support according to claim 1, wherein each of said at least two spacers has a running roller.

4. The ladder support according to claim 3, wherein said running roller is a pair of running rollers.

5. The ladder support according to claim 3, wherein said running roller is articulatably disposed on each of said at least two spacers.

6. The ladder support according to claim 1, wherein each of said at least two spacers is adjustable in length.

7. The ladder support according to claim 1, wherein each of said at least two spacers is laterally adjustable on said inside of said abutment angle.

8. The ladder support according to claim 1, including releasable clamping devices for fastening each of said at least two supporting rods to a ladder.

9. The ladder support according to claim 8, wherein said clamping device is angularly adjustable.

10. The ladder support according to claim 1, further comprising at least two displaceable spacers, said abutment angle having two legs, and said at least two displaceable spacers displaceably mounted and guideable along a respective one of said two legs.

11. The ladder support according to claim 10, wherein said at least two displaceable spacers are adjustable in length.

12. The ladder support according to claim 1, wherein said rollers are at least two rollers, said ends of said bearing bar is two ends, and each of said two ends has at least one of said at least two rollers.

13. The ladder support according to claim 12, wherein each of said two ends has a roller pair.

14. The ladder support according to claim 12, wherein at least one of said at least two rollers is adjustably guided on each of said two ends of said bearing bar.

15. The ladder support according to claim 12, wherein each of said two ends of said bearing bar has sides defining a cavity and said at least one of said at least two rollers is adjustably guided within said cavity.

16. The ladder support according to claim 1, wherein said abutment angle has two legs, each of said two legs having respective ends, and each of said ends has a telescopic extension arm.

17. The ladder support according to claim 16, wherein said telescopic extension arm is angled.

18. The ladder support according to claim 16, wherein said telescopic extension arm has at least one roller.

19. The ladder support according to claim 1, wherein said abutment angle has at least one leg and at least one of said at least two spacers are displaceably mounted and guideable along said at least one leg.

20. The ladder support according to claim 19, wherein at least one of said at least two spacers are adjustable in length.

* * * * *